United States Patent [19]

Crunkleton et al.

[11] Patent Number: 4,862,694

[45] Date of Patent: Sep. 5, 1989

[54] CRYOGENIC REFRIGERATION APPARATUS

[75] Inventors: James A. Crunkleton, Cambridge; Joseph L. Smith, Jr., Concord, both of Mass.

[73] Assignee: Massachusetts Institute of Technology, Cambridge, Mass.

[21] Appl. No.: 205,216

[22] Filed: Jun. 10, 1988

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,143,520 | 3/1979 | Zimmerman | 62/6 |
| 4,498,296 | 2/1985 | Dijkstra et al. | 62/6 |
| 4,622,823 | 11/1986 | Ishizawa et al. | 62/6 |

*Primary Examiner*—Ronald C. Capossela

*Attorney, Agent, or Firm*—Robert F. O'Connell

[57] ABSTRACT

A technique for producing a cold environment wherein warm fluid, e.g. at room temperature, from a compressor, is introduced under pressure into an input channel which is directly coupled to a displacement volume, the fluid being precooled in the input channel to a temperature lower than that of the input fluid. Fluid in the inner channel at or near the displacement volume is periodically pressurized to a high pressure. The displacement volume is then expanded so that the high pressure fluid flowing into the expanded volume is decreased from such high pressure to a substantially lower pressure, the temperature thereof being reduced to a substantially lower temperature for producing the cold environment. The low pressure, low temperature fluid flows into an output channel, preferably via a suitable valve and surge volume, for flow in the output channel at a substantially constant pressure. A direct heat exchange is provided between the input and output channels to provide the precooling of the input fluid and a warming of the fluid in the output channel to a temperature relatively close to, but below, the temperature of the input fluid. The warmed fluid exiting from the output channel is supplied to the compressor when it is compressed for re-introduction into the input channel.

28 Claims, 4 Drawing Sheets

CRYOGENIC REFRIGERATION APPARATUS

INTRODUCTION

This invention relates generally to cryogenic refrigerant apparatus for providing a fluid at extremely low temperatures and, more particularly, to such an apparatus which uses a technique for permitting such low temperatures to be reached in an efficient manner even when the size of the apparatus is reduced in scale.

BACKGROUND OF THE INVENTION

Two well-known techniques have been suggested for use in achieving low temperature or cryogenic operation, particularly using helium as a fluid, for example. One approach, often referred to as a Collins cycle (alternatively such approach is often referred to as a multistage Claude cycle), is described in one of its basic forms in U.S. Pat. No. 2,458,594 issued on Jan. 11, 1949 to S. C. Collins. The Collins cycle is used to provide refrigeration or liquefaction at "liquid-helium" temperatures. The Claude cycle is used to provide refrigeration or liquefication at higher temperatures using fluids such as nitrogen. Improvements and modifications to the basic technique have also been described in U.S. Pat. Nos. 2,607,322 and 3,438,220, for example, issued to S. C. Collins on Aug. 19, 1952 and Apr. 15, 1969, respectively.

In such approach, high pressure fluid from a compressor is passed through a heat exchanger and introduced, via a high pressure valve, into an expansion engine comprising a chamber having a moveable member such as a piston positioned therein When the fluid is so introduced, the piston moves within the chamber to form an expansion volume, the expansion of the fluid causing the heat energy to be transferred therefrom via the performance of mechanical work, as on a crankshaft, for example, connected to the piston. In the expansion operation, the temperature and pressure of th fluid are reduced considerably. The fluid is then conveyed via a low pressure valve from the expansion volume to a space to be cooled, for example, and then back to the compressor in a countercurrent flow through the heat exchanger.

The pressure of the fluid as it flows in both direction through the heat exchanger is maintained substantially constant both during the high pressure flow from the input side to the expansion engine and during the low pressure flow from the expansion engine to the output side. Further, during the high and low pressure flows there is substantially little or no intermediate storage of heat energy involved. Moreover, in specific embodiments of the technique, the high pressure valve and the low pressure valve are both located in the apparatus at the low temperature region thereof.

While the Collins cycle technique is effective when used for relatively large-scale production of low temperature helium, for example, it has been found to be difficult to scale down the apparatus size when a smaller system is required and still retain the low temperature effectiveness thereof.

Another approach used in the art to achieve low temperature operation is often referred to as the Gifford-McMahon cycle technique, an approach which has sometimes been proposed as effective when used for such smaller scale systems. The Gifford-McMahon cycle is commonly used in single- and multiple-stage configurations. A multi-stage Gifford-McMahon cycle, however, is not capable of producing liquid-helium temperatures with conventional regenerator materials. Refrigeration in a Gifford-McMahon operation results from a difference in enthalpy rates between the entering high pressure stream and the exiting low pressure stream. A basic description of the Gifford-McMahon operation is set forth in U.S. Pat. No. 3,045,436, issued on Jul. 24, 1962 to W. E. Gifford and H. O. McMahon. Other apparatus using Giffin-McMahon principles of operation are also described, for example, in U.S. Pat. Nos. 3,119,237 and 3,421,331 issued on Jan. 28, 1964 and Jan. 14, 1969 to W. E. Gifford and to J. E. Webb, respectively.

In such systems, no heat energy is transferred from the expanding fluid through the performance of mechanical work external to the refrigerator. While a moveable displacer element is periodically moved within the apparatus to provide for an expansion chamber, such element is not arranged so as to produce mechanical energy exchange. Rather, multiple confined fluid volumes are balanced so as to act in conjunction with one another so that compression and expansion are selectively controlled using inlet and exhaust valves at room temperatures and a net refrigeration is produced at one or more points in the system.

In such an approach, the confined fluid volumes on either end of the displacer are connected by a heat exchange passage called a thermal regenerator. Thus, the regenerator undergoes the same pressure cycling as the confined fluid volumes In this configuration, the heat energy is normally fully stored for a half cycle in the regenerator matrix, which requires the regenerator matrix to have a large heat capacity. In totally regenerative cycles, such as in the Gifford-McMahon approach, the pressure ratio is effectively limited by the gas volume in the regenerator, which must be large enough so that the low-pressure flow pressure drop through the regenerator matrix is not excessive.

Common regenerator materials have a heat capacity that diminishes at very low temperatures For this reason, the Gifford-McMahon cycle alone is not capable of producing cooling at liquid-helium temperatures, even when multiple stages are used. To reach liquid-helium temperatures, a second thermodynamic cycle such as a Joule-Thomson cycle must be used in parallel with the Gifford-McMahon cycle. The Joule-Thomson cycle consists of a pre-cooling counterflow heat exchanger and an expansion valve (commonly referred to a the Joule-Thomson expansion valve). Neither the Gifford-McMahon nor the Joule-Thomson cycles are capable of reaching liquid-helium temperatures independently. The Gifford-McMahon stages provide precooling of the helium gas in the counterflow heat exchanger of the Joule-Thomson cycle in preparation to expand the gas over the Joule-Thomson expansion valve. This combined cycle configuration is capable of producing cooling at liquid-helium temperatures. However, integrating these two cycle configurations is undesirable for two reasons. First, mechanically combining the two configurations is somewhat cumbersome, especially during manufacture. Second, the optimal mean cycle pressures and pressure ratios for the two cycles are not compatible, which requires a special compressor configuration. It is desirable to combine the advantages of regenerative heat exchange, as in the Gifford-McMahon cycle with the advantages of counterflow heat exchange as in the Collins approach in a single package that uses, for example, a displacer type expansion engine, particularly for designing a relatively scaled-down refrigeration apparatus which may be required in many applications.

BRIEF SUMMARY OF THE INVENTION

In accordance with a preferred embodiment of the invention, a displacement volume is directly coupled to one end of an input channel and fluid therein is periodically re-compressed to a high pressure by reducing the displacement volume to a substantially zero volume. By opening a valve at the other end of the input channel, and by increasing the displacement volume, further fluid under pressure as supplied from an external compressor is caused to flow into the channel at a first relatively warm temperature (e.g., room temperature). The fluid introduced into the first channel is pre-cooled as it flows therein towards the region of the channel at or near the displacement volume. A residual portion of the expanded fluid which has resulted from the expanded operation of a previous cycle remains in the displacement volume and in the input channel. The fluid which is re-compressed in the channel at a region thereof at or near the displacement is re-compressed at a second temperature which is lower than the first temperature.

The displacement volume is then increased to form an expanded volume so that the pre-compressed fluid is expanded from the high pressure at which it had been pressurized to a substantially lower pressure so as to reduce the temperature of the fluid at or near the displacement volume to a third temperature which is substantially lower than the first temperature. The displacement volume is then decreased and a portion of the very low temperature, low pressure, expanded fluid which is used to produce the cold environment is caused to flow from the expanded displacement volume as a result of a decrease in the displacement volume into a second output channel. The low temperature expanded fluid is used to produce a cold environment, heat being transferred from the environment to the expanded fluid thereby warming the low temperature expanded fluid.

The expanded low temperature, low pressure fluid from the displacement volume is caused to flow in the output channel at a substantially constant flow rate at a substantially constant pressure to a fluid exhaust exit at the output end of the channel. A direct heat exchange is provided between the input and output channels to produce the pre-cooling of the fluid in the input channel and a warming of the fluid in the output channel to a temperature near the first temperature less allowance of a heat exchange temperature difference prior to its exit therefrom. The warm exiting fluid is then supplied to the external compressor for compression thereof so as to supply the fluid under pressure from the compressor for the next operating cycle. The overall re-compression and expansion process is then repeated, the fluid in the displacement volume and in the input channel being again periodically re-compressed and the expansion thereof occurring as before.

Such an approach permits the system to be implemented as a relatively compact, i.e., relatively small scale, device. As such device is scaled down in size, the amount of surface area available for heat exchange per unit volume becomes comparable with the area required for efficient heat exchange so that, even for relatively small scale configurations, the overall system readily provides the necessary heat transfers to produce an efficient operation. Accordingly, a relatively small scale system can provide excellent low temperature operation at a relatively high efficiency substantially as good as that achieved by Collins cycle operation in large scale devices. At the same time the low temperatures and efficiency thereof are significantly better than those achievable by relatively small-scale devices which operate in accordance with a Gifford-McMahon cycle.

DESCRIPTION OF THE INVENTION

The invention can be described in more detail with the help of the drawings wherein FIG. 1 depicts a view generally in section of a apparatus in accordance with the invention;

Figure 1:
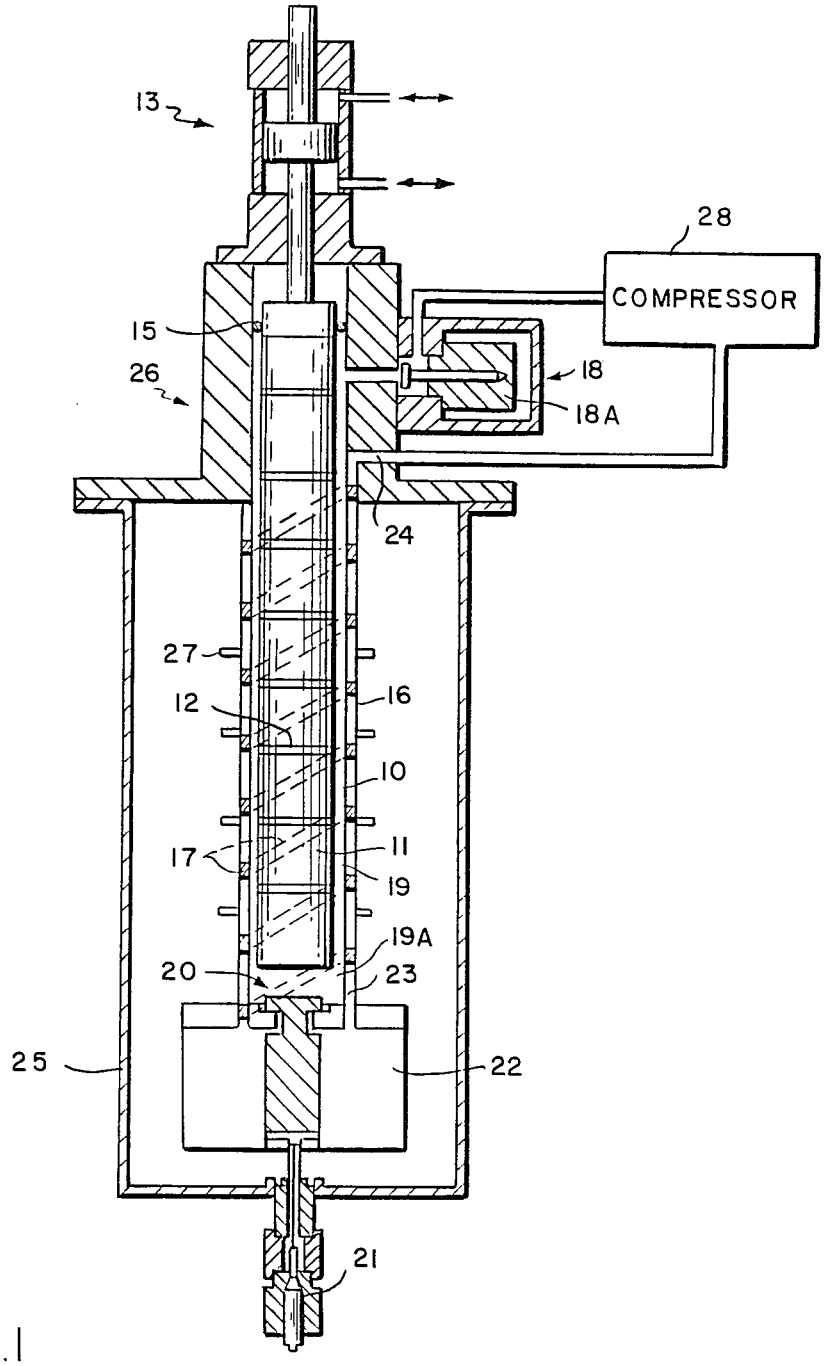
FIG. 1A depicts a pressure volume curve showing operation of a typical system in accordance with the invention.

As can be seen in FIG. 1, a typical single stage system is shown in accordance with one particular embodiment of the invention. The apparatus depicted therein utilizes a cylinder 10 which has mounted therein a displacer, or piston, element 11 having suitable support disks 12 for providing adequate strength for the displacer against pressure exerted thereon. The displacer is appropriately coupled to a drive mechanism 13 which can be any suitable means for absorbing energy, e.g., by performing mechanical work, and for controlling the cyclic speed of operation of the apparatus. The particular drive mechanism shown in FIG. 1, for example, is a hydraulic cylinder means, the structure and operation of which would be well-known to the art. Other means such as a mechanical crankshaft mechanism or a gas balancing chamber, such as described in the aforementioned U.S. Pat. No. 3,421,331, as would be well known to the art, may also be used for such purpose, for example.

An outer cylindrical shell 16 is formed concentrically wit the wall of cylinder 10 and is separated from the outer wall of cylinder 10 through the use of a spiral, or helical, spacer element 17. A high pressure intake valve assembly 18 having a valve operated by an appropriate valve operating solenoid 18A is mounted at room temperature at the upper portion of the apparatus so as to introduce fluid periodically at a high pressure into an input channel 19 formed between the outer wall of the displacer element 11 and the inner wall of cylinder 10. The high pressure fluid is supplied, for example, from a suitable compressor 28 at a selected high pressure substantially at room temperature. A displacement volume, or expansion volume, 19A is formed at the end of the input channel 19 at the lower end of cylinder 10 and is directly coupled to channel 19.

A low pressure exhaust valve 20 is positioned at the lower end of cylinder 10, such valve also being operated by an appropriate valve operating solenoid 21. A surge volume, or chamber, 22 is formed below cylinder 10 and is coupled to the displacement volume 19A via exhaust valve 20. The surge volume 22 is directly coupled to an outer channel 23 formed between the outer wall of cylinder 10 and the wall of outer cylindrical shell 16. A low pressure exhaust exit 24 is positioned at the top of outer channel 23 so as to supply exhaust fluid to compressor 28. In accordance with the structure shown, the wall of cylinder 10 acts as a common wall for both input channel 19 and output channel 23.

The overall assembly is encased in a hermetically sealed outer cylinder 25 which encloses the lower portions of cylinder 10, displacer 11, and outer shell 16. A housing assembly 26 encloses the upper portions of the cylinder and the displacer element, the latter being mechanically coupled to the drive mechanism 13, as shown.

For the most part the various elements of the housing and operating parts of the apparatus can be made of stainless steel, for example. The outer surface of the displacer can be coated with Teflon to reduce its sliding friction. The displacer support disks 12 and the plurality of round-out ring elements 27 are used to maintain the shape of the device during the pressure cycling operation. Both the solenoids for the high pressure and the low pressure valves can be operated at room temperature, the high pressure valve itself operating at room temperature and the low temperature valve itself operating at the low refrigeration temperatures.

The hydraulic drive mechanism 13 having a pump and appropriate valving (not shown) coupled to the displacer 11 is used to absorb the expander power output during the expansion stroke when the displacement volume is expanded and to reduce the expanded displacement volume during the exhaust and compression stroke. The speed of such cyclic operation of the system is controlled by drive mechanism 13 in accordance with a desired periodic cycle speed of operation.

During the compression portion of the cyclic operation of the device of FIG. 1, the volume of displacement volume 19A is reduced substantially to zero so as to place any residual fluid therein and in channel 19 under pressure. The displacer element 11 is positioned at that time such that it is extended downwardly into the cylinder 10 so that its lower surface effectively rests substantially at or near the bottom of the displacement volume 19A. A high pressure fluid, such as helium, is supplied from compressor 28 to the input side of high pressure valve 18 substantially at room temperature. The high pressure fluid is introduced, when valve 18 is suitably actuated so as to open, into input channel 19, valve 18 being actuated periodically to introduce such high pressure fluid on a periodic basis into channel 19 where it flows therein at said high pressure toward the reduced displacement volume 19A. At that point any residual fluid in the displacement volume and fluid in the input channel is at a high pressure. During the intake portion of the operation, for example, when the pressure effectively reaches its highest level, the displacer 11 can be displaced upwardly so that, as more fluid flows into channel 19 before valve 18 is closed, such high pressure is maintained for a selected time period before the expansion portion of the operation.

During the expansion portion of the operation the displacer is displaced upwardly to produce a fully expanded displacement volume 19A which acts to reduce the high pressure of the fluid therein to a substantially lower pressure and, accordingly, to reduce the temperature of the fluid to a substantially lower temperature which can be used to produce a desired cold environment.

During the expansion of the high pressure fluid therein, energy which is released from the fluid is converted, for example, to mechanical energy as displacer 11 is moved upwardly in cylinder 10, such movement being used, for example, to perform mechanical work via the drive mechanism 13.

Low pressure valve 20 is thereupon actuated and the displacement volume is again decreased by movement downwardly of the displacer 11 so as to cause a portion of the low temperature fluid to flow from the displacement volume 19A into a surge volume 22 and thence to output channel 23. The surge volume smooths the periodic nature of the flow of such low pressure fluid from the displacement volume so that the fluid flows continuously through channel 23 at a substantially constant flow rate at a substantially constant pressure and thence outwardly from exhaust exit 24 thereof back to the compressor 28. A residual portion of the cold fluid remains in the displacement volume and in channel 19 after valve 20 is closed at the end of the exhaust portion of the cycle.

In accordance with the operation of such system, there is a regenerative heat transfer between the fluid flowing in channel 19 and the walls of the reciprocating displacer element 11 and the cylinder 10 and a counterflow direct heat exchange, or direct heat transfer, between the high and low pressure fluid streams flowing in channels 19 and 23, respectfully. Thus, in the latter case heat is transferred from the high pressure warm stream in channel 19 directly to the low pressure colder stream in channel 23 via common wall 10 of the cylinder so as to pre-cool the high pressure fluid prior to the expansion thereof at the displacement volume and to warm the low pressure fluid to a temperature near, but below, the temperature of the intake fluid, as mentioned above, prior to its flowing to the exhaust exit.

Figure 1A:
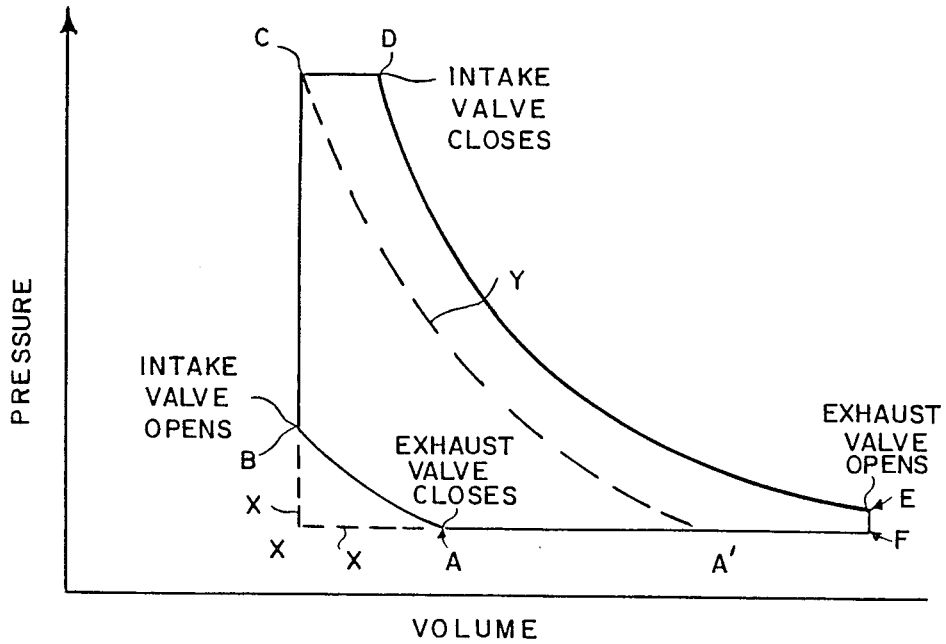

In further understanding the above exemplary operation of the system it is helpful to consider the pressure/-volume graphical presentation in FIG. 1A. The cyclic operation can be described by pointing out therein the various portions of the overall operation occurring in accordance with the exemplary operation described above. The beginning of the overall pressurization operation is designated as point A, and the subsequent movement of the displacement element 11 to cause a decrease in the displacement volume 19A is represented as the portion of the curve from point A to point B. At point B the intake valve 18 is actuated (opened) to cause fluid under pressure to enter input channel 19 so as to contribute to the pressurization of the fluid therein and in the displacement volume to its highest pressure in the operation at point C. Such high pressure can be maintained substantially at such high level until point D by increasing the displacement volume slightly as the high pressure fluid continues to enter channel 19.

At point D, the intake valve 18 is closed and the expansion portion of the operation begins. The displacement volume is expanded to its maximum expansion volume and the pressure of the fluid therein and in channel 19 is reduced to point E at which point the exhaust valve 20 is opened. There is a slight drop in pressure to point F (sometimes referred to as the "blowdown" portion of the operation) and fluid is then caused to flow into the surge volume for subsequent flow into the output channel 23 at a substantially constant pressure and at a substantially constant flow rate during the exhaust portion of the operation from point F to point A, at which point the exhaust valve 20 is closed and the pressurization portion of the operation can begin again.

In the preferential operation depicted in FIG. 1A, pressurization to the pressure level at point B occurs due to re-compression of residual fluid in displacement volume 19A and in channel 19 by reducing the displacement volume effectively to zero (point A to point B) and due to the entry of fluid under pressure from compressor 28 into input channel 19 (point B to point C). While such pressurization is depicted effectively in sequence in FIG. 1A, it should be understood that the pressurization due to reduction of the displacement volume and due to the introduction of high pressure fluid can occur substantially simultaneously. In such case, for example, the intake valve can be eliminated and the compressor piston and displacer element 11 can be moved at the same cyclic speed, but out-of-phase with each other.

As an alternative, the pressurization can be arranged to occur substantially primarily (or substantially solely) by decreasing the displacement volume and not depending upon a pressure increase due to the introduction of high pressure fluid into channel 19 for compressor 28. Such operation is effectively represented by the dashed line curve Y, the exhaust valve closing at point A and the intake valve opening at point C rather than at point B.

As a further alternative, such pressurization can occur substantially primarily (or substantially solely) due to the introduction of high pressure fluid from the compressor into channel 19 with little or no contribution due to pressurization caused by reduction of the displacement volume to pressurize the residual fluid therein. For such alternative operation, the P/V curve would in effect follow the dashed line curve X, the exhaust valve closing and the intake valve opening at substantially the same time at point X'. Pressurization then occurs from point X' to point C.

Further, while maintenance of high pressure is shown in FIG. 1A to occur from point C to point D, it should be understood that such operation need not occur if there is pressurization from point B to point C, and the intake valve can be closed essentially at point C when high pressure is reached and the expansion can effectively begin from point C to point E.

In a design in accordance with the invention, the range of the ratio of intake pressure to exhaust pressure can be as high as about 10 to 1 up to about 20 to 1, and possibly even higher. Such ratios can be achieved with a range of intake pressures of as high as about 40 atmospheres (ATM) and an exhaust low pressure of as low as about 1 ATM to 4 ATM, for example.

The use of a helical, or spiral, spacer 17 tends to minimize flow maldistributions in output channel 23 which would tend to reduce the desired heat exchange efficiency of the system. Further, the use of surge volume 22 with the output channel 23 effectively improves the counterflow heat exchange by acting as a mechanical resistance-capacitive (RC) filter to the low pressure return. The amount of surge volume (C) is adjusted at the low temperature region and the amount of flow resistance (R) in the low pressure return passages is adjusted in order to obtain an RC time constant which is approximately equal to the period of one cycle. The result of using spacer 17 and surge volume 22 is to better achieve the desired substantially constant fluid flow rate in output channel 23.

The use of such a structure with the direct counterflow heat transfer, or exchange, provided between the channels throughout the overall cycle of operation and the regenerative heat exchange during pressure cycling of the input channel, as mentioned above, together with the periodic supplying of a flow of higher temperature input fluid at high periodic pressure and a substantially constant flow of low temperature output fluid at a substantially constant low pressure provides a very efficient overall system for achieving extremely low temperature operation even for relative small scale structures.

As an example of a system in accordance with the invention, temperatures as low as 30°K. can be achieved in a single-stage system such as depicted in FIG. 1, for example, for structures in which the diameter of cylinder 10 is about one inch, the length thereof is about 20 inches, and the channel widths for channels 19 and 23 are about 0.005 inches and 0.010 inches, respectively. The displacer element 11 can be moved at a cyclic speed of approximately 90 r.p.m., for example. The wall thicknesses can be selected as desired for appropriate mechanical integrity.

Figure 2:
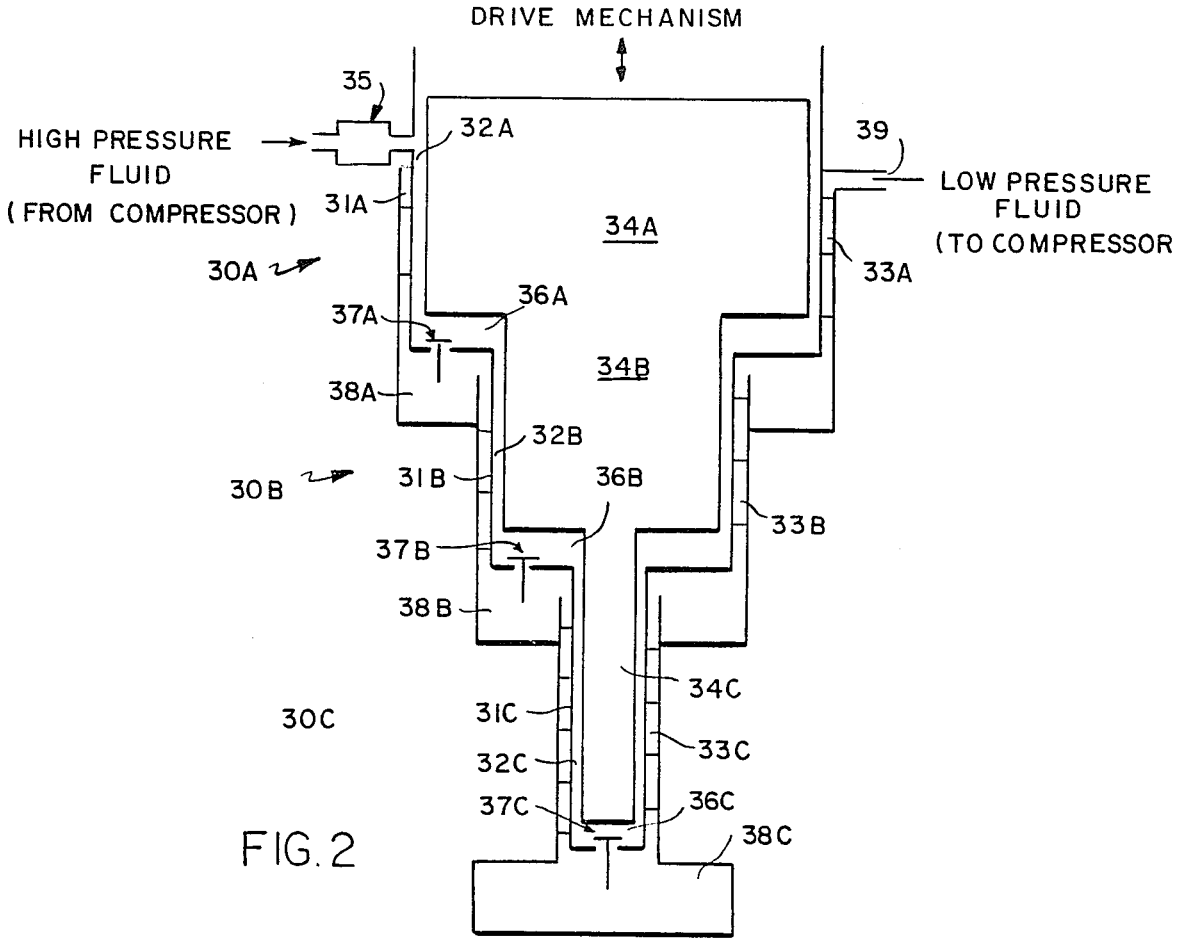
FIG. 2 depicts a diagrammatic view of a multi-stage embodiment of the invention.

An alternative embodiment of the invention can utilize a multi-stage construction such as shown, for example, in FIG. 2. As can be seen therein, the stages have progressively smaller diameters for the cylinders and displacer element portions used therein, the cylinder and displacer structures being integrally formed as shown.

Thus, the three stages 30A, 30B, and 30C include progressively smaller diameter cylindrical portions 31A, 31B and 31C, displacer portions 34A, 34B and 34C, input channels 32A, 32B, and 32C, and output channels 33A, 33B, and 33C. The input channels are periodically supplied with high pressure fluid from a compressor via high pressure valve 35, which causes the displacer portions to be moved vertically upwardly to form expansion volumes 36A, 36B, and 36C.

The high pressure fluid expanding in volume 36A is thereupon cooled to a low temperature and a portion thereof continues to flow through channel 32B to volume 36B where it is expanded and further cooled and thence a further portion thereof through channel 32C to volume 36C where it is expanded and still further cooled. Valve 35 is closed and the exhaust valves 37A, 37B, and 37C are thereupon actuated to cause the portions of expanded fluid in the corresponding expansion volumes to be supplied to surge volumes 38A, 38B, and 38C. The cold fluid at its lowest temperature in surge volume 38C thereupon flows through output channels 33C, 33B, and 33A at each stage to exhaust exit 39. The surge volumes tend to assure that the fluid flow through the output channels is at a substantially constant flow rate and pressure. The use of three stages each operating substantially simultaneously, but effectively in series with respect to temperature, in substantially the same manner as discussed above with respect to the single stage structure of FIG. 1, produces much lower temperatures for the output low pressure fluid at the final stage than is achievable using only a single stage configuration as in FIG. 1.

Figure 3:
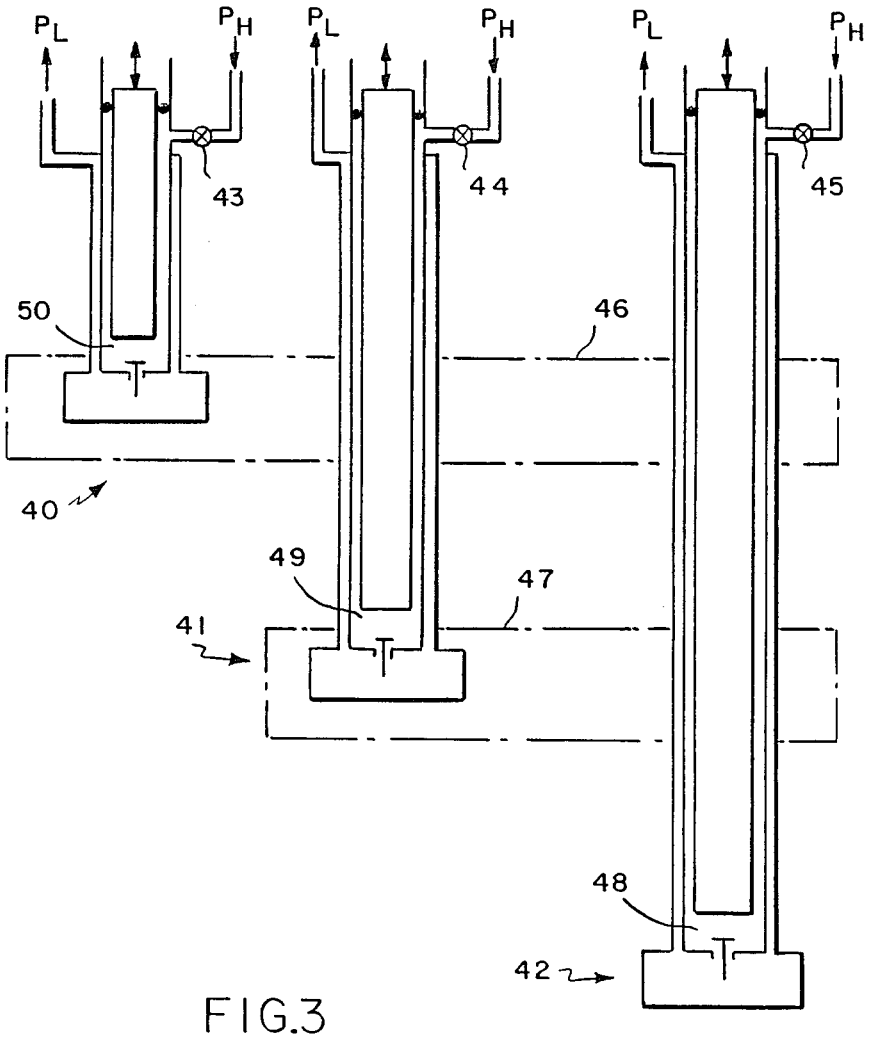
FIG. 3 depicts a diagrammatic view of an alternative multi-stage embodiment of the invention.

As an alternative to the particular multi-stage configuration of FIG. 2, another multi-stage configuration is shown in FIG. 3. As can be seen therein, each of the stages 40, 41 and 42 is represented by a separately configured single-stage of the type shown in FIG. 1 operating essentially in parallel with each of the other stages. The stages are shown diagrammatically only for convenience and details of each of the single-stage structures and their operations are not shown in or discussed in connection with FIG. 3 since such details have already been discussed with reference to FIG. 1. High pressure fluid ($P_H$) is simultaneously supplied from a compressor (not shown) to each of the stages via high pressure input valves 43, 44 and 45, respectively. Low pressure output fluid ($P_L$) is supplied at the low pressure exits of each stage, as shown, back to the compressor. Thermal communication is provided among the stages by the use of thermal communication blocks 46 and 47 made of solid blocks of a material having a high thermal conductivity, such as copper. Each such block assures that the temperatures at the regions of each stage at which each block is in thermal contact are maintained at the same temperature. The temperature at the expansion volume region 48 of stage 42 is substantially lower than that at the expansion volume region 49 of stage 41 which is in turn substantially lower than that at the expansion volume region 50 of stage 40.

Figure 4:
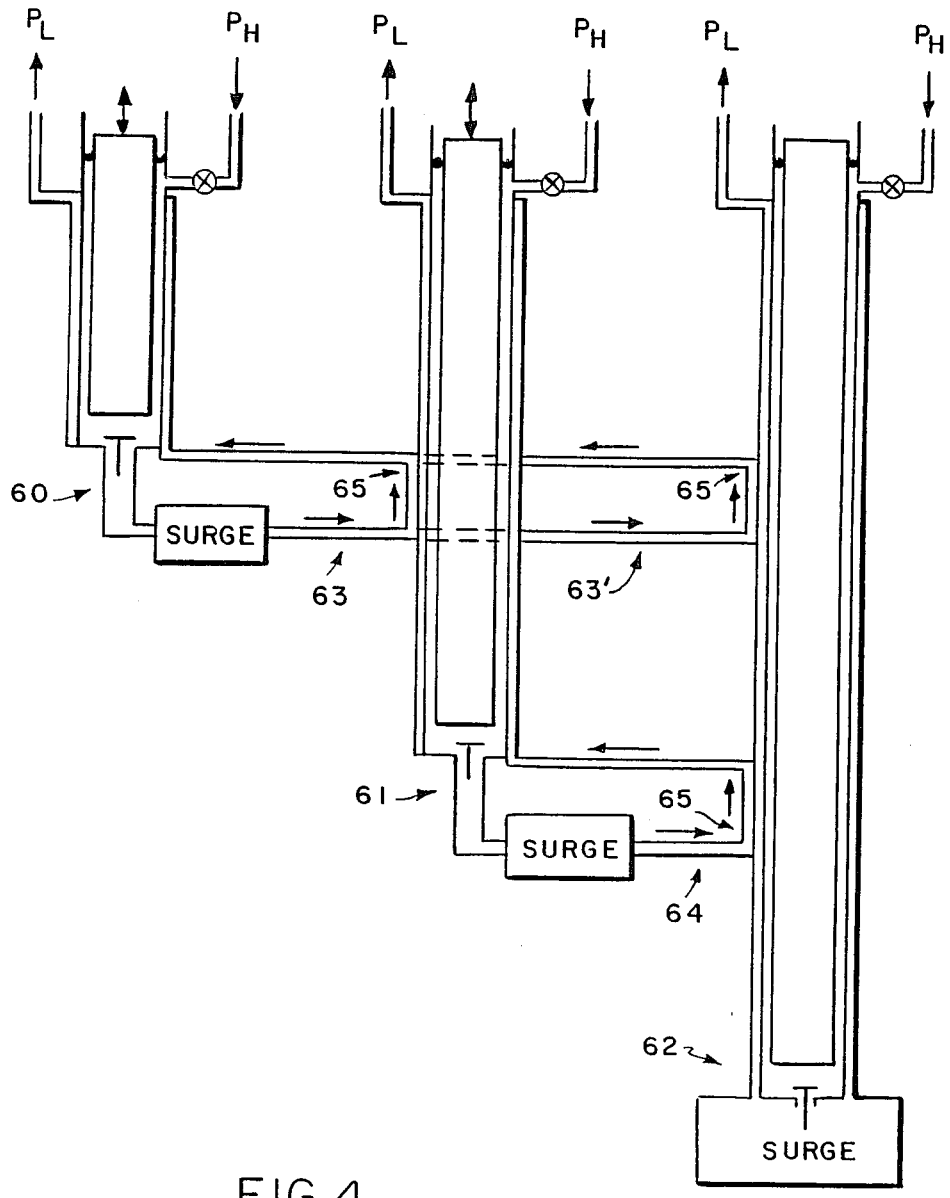
FIG. 4 depicts a diagrammatic view of still another alternative multi-stage embodiment of the invention.

An alternative embodiment of a multi-stage structure similar of that shown in FIG. 3 is shown in FIG. 4 using stages 60, 61, and 62 in which a similar operation occurs as in the structure of FIG. 3. In FIG. 4, instead of utilizing thermal communication blocks as in FIG. 3, the system makes use of additional fluid diversion channels 63/63' and 64. Channel 63/63', for example, carries low temperature fluid from the low pressure expansion volume and surge volume of stage 60 to a regions 65 and 65' adjacent to, and in thermal contact with, the low pressure output channels of stages 61 and 62, while channel 64 carries low temperature fluid from the expansion volume and surge volume of stage 61 to a region 66 adjacent to, and in thermal contact with, the low pressure channel of stage 62.

While the specific embodiments shown and discussed with reference to FIGS. 1–4 represent preferred embodiments of the invention, modifications thereof within the spirit and scope of the invention may occur to those in the art. For example, while the embodiment discussed with reference to FIG. 1 uses an operation in which the high pressure fluid from compressor 28 is introduced into channel 19 and the output fluid to compressor 28 flows through channel 23, the use of such channels can be reversed. While such an alternative embodiment can be arranged, it is believed that the operation thereof will not be as effective as that provided by the preferred embodiment discussed above. In the reverse case, high pressure fluid at room temperature from compressor 28 is introduced directly into channel 23 (which in effect becomes the input channel) and low pressure, low temperature output fluid is caused to flow in channel 19 (which in effect becomes the output channel). In such case, the input fluid flows in channel 23 at a substantially constant pressure and the output fluid flows at a periodic pressure and a heat exchange still occurs between the warm input fluid and the low temperature output fluid to pre-cool the former and to warm the latter. In any event, in either operation, the fluid in channel 19 which is directly coupled to the displacement volume 19A is periodically pressurized and the fluid in channel 23 which is not directly coupled to displacement volume 19A is at a substantially constant pressure.

Other modifications may occur to those in the art and, hence, the invention is not to be construed as limited to the particular embodiments disclosed, except as defined by the appended claims.

What is claimed is

1. A method of producing a cold environment comprising the steps of (a) periodically introducing fluid under pressure from a compressor at a first temperature into a first channel for flowing therein, said first channel being directly coupled to a displacement volume;

(b) pre-cooling the fluid flowing in said first channel from said first temperature to a second temperature lower than said first temperature;

(c) periodically pressurizing fluid at said second temperature in said first channel at or near said displacement volume to a high pressure;

(d) periodically increasing the displacement volume to produce an expanded volume so as to expand the pressurized fluid flowing into said expanded volume from said first channel from said high pressure to a substantially lower pressure so as to reduce the temperature thereof to a third temperature substantially lower than said second temperature;

(e) causing fluid at said third temperature and at said lower pressure to flow from said displacement volume, when said displacement volume has been periodically decreased, at a substantially constant pressure into a second channel not directly coupled to said displacement volume for flow therein;

(f) providing a direct heat exchange between fluid flowing in said first channel and fluid flowing in said second channel to produce the pre-cooling of the fluid flowing in said first channel substantially to said second temperature and a warming of the fluid flowing in said second channel to a temperature substantially near said first temperature; and (g) supplying the fluid from said second channel to said compressor for compression thereof by said compressor so as to provide the fluid under pressure for introduction into said first channel.

2. A method in accordance with claim 1 wherein step (c) includes recompressing said fluid substantially primarily by periodically reducing said displacement volume to recompress the fluid therein and in said input channel to said high pressure.

3. A method in accordance with claim 1 wherein step (c) includes pressurizing said fluid substantially primarily by permitting the fluid flowing in said input channel under pressure to pressurize the fluid in said input channel and in said displacement volume to said high pressure.

4. A method in accordance with claim 1 wherein step (c) includes pressurizing said fluid by (1) periodically reducing said displacement volume and by (2) periodically permitting the fluid flowing in said input channel under pressure, to place the fluid thereby being pressurized in said displacement volume and in said input channel to said high pressure.

5. A method in accordance with claim 4 wherein steps (1) and (2) are performed substantially in sequence.

6. A method in accordance with claim 4 wherein steps (1) and (2) are performed substantially simultaneously.

7. A method in accordance with claim 4 wherein fluid is caused to flow substantially at said third temperature through a surge volume to said second channel at a substantially constant flow rate and substantially constant pressure.

8. A method in accordance with claim 1 and further including the performing of steps (a) through (g) at a plurality of separate operating stages.

9. A method in accordance with claim 8 and further coupling the first channel of each stage, other than the first stage wherein the temperatures thereof are warmer than the corresponding temperatures of the successive stages, to the displacement volume of the preceding stage and coupling the second channel of each stage, other than the first stage, to the second channel of the preceding stage.

10. A method in accordance with claim 8 wherein each of said separate operating stages operates parallel with the othe operating stages and the fluid at said third temperature at all stages, except one, is thermally coupled to selected regions of at least one of the other operating stages.

11. A method of producing a cold environment comprising the steps of (a) introducing fluid at a substantially constant pressure from a compressor at a first temperature into a first channel for flowing therein to a displacement volume and to a region of a second channel directly coupled to said displacement volume at or near said displacement volume, said first channel not being directly coupled to a displacement volume;

(b) precooling the fluid flowing in said first channel from said first temperature to a second temperature lower than said first temperature;

(c) periodically pressurizing fluid at said second temperature in said second channel at or near said displacement volume to a high pressure;

(d) periodically increasing the displacement volume to produce an expanded volume so as to expand the pressurized fluid flowing into said expanded volume from said second channel from said high pressure to a substantially lower pressure so as to reduce the temperature thereof to a third temperature substantially lower than said second temperature;

(e) causing fluid at said third temperature at said lower pressure to flow from said displacement volume, when said displacement volume is decreased, into said second channel for flow therein;

(f) providing a direct heat exchange between fluid flowing in said first channel and fluid flowing in said second channel to produce the pre-cooling of the fluid flowing in said first channel substantially to said second temperature and warming of the fluid flowing in said second channel to temperature substantially near said first temperature; and (g) supplying the fluid from said second channel to a compressor for compression thereof by said compressor so as to provide the fluid under pressure for introduction into said first channel.

12. A system for providing a low temperature fluid, said system comprising a displacement volume;

input channel means directly coupled to said displacement volume;

compressor means for providing fluid under pressure at a first temperature;

input means for introducing said fluid under pressure from said compressor means into said input channel for flow therein at a periodic pressure to a region at or near said displacement volume;

moveable means for expanding or reducing said displacement volume;

pressurization means for causing fluid supplied to said input channel means at or near said displacement volume to be periodically pressurized to a high pressure at a second temperature lower than said first temperature;

means for causing said moveable means to expand said displacement volume so as to reduce the high pressure of the fluid flowing therein from said input channel to a substantially lower pressure and to reduce the temperature of the fluid therein to a third temperature substantially lower than said second temperature;

output means for causing fluid at said lower pressure and at said third temperature to flow from said displacement volume to an output channel not directly coupled to said displacement volume for flow therein at a substantially constant pressure;

said input and output channels being directly thermally coupled to provide a direct exchange of heat between the fluid flowing in said input channel and said output channel to precool the fluid in said input channel and to warm the fluid in said output channel; and means for supplying said warmed fluid from sad output channel to said compressor means.

13. A system in accordance with claim 12 wherein said pressurization means includes said means for causing said moveable means to reduce said displacement volume to a substantially zero volume to cause fluid supplied in said input channel and the region at or near said displacement volume to be recompressed to said high pressure.

14. A system in accordance with claim 12 wherein said pressurization means includes said means for introducing fluid into said input channel under pressure to place fluid in said input channel and in the region at or near said displacement volume at said high pressure.

15. A system in accordance with claim 12 wherein said pressurization means includes said means for causing said moveable means to reduce said displacement volume to a substantially zero volume and said means for introducing fluid under pressure into said input channel whereby fluid in said input channel and in the region at or near said displacement volume is pressurized to said high pressure.

16. A system in accordance with claim 12 wherein said input means includes a valve means.

17. A system in accordance with claim 12 wherein said output means includes a valve means.

18. A system in accordance with claim 17 wherein said output means further includes surge volume means positioned between said valve means and said output channel.

19. A system in accordance with claim 17 and further including flow distributing means in said output channel for preventing maldistribution of the flow of fluid therein, said surge volume means and said flow distributing means assuring a substantially constant flow rate of fluid flowing in said output channel.

20. A system in accordance with claim 19 wherein said flow distributing means is a spiral spacer means positioned within said output channel means.

21. A multi-stage system for providing a low temperature fluid comprising a plurality of systems, each in accordance with claim 12, arranged to form a plurality of successive stages thereof, the input channel of a stage, other than the first stage wherein the temperatures are warmer than the corresponding temperatures of the successive stages, being coupled to the input channel of a previous stage and the output channel of a stage, other than the first stage, being coupled to the output channel of a previous stage.

22. A multi-stage system in accordance with claim 21 wherein said input channel of a stage is coupled to the input channel of a previous stage via the displacement volume of the previous stage.

23. A multi-stage system in accordance with claim 22 wherein the output means of each stage includes a surge volume and the output channel of a stage is coupled to the output channel of a previous stage via the surge volume of the previous stage.

24. A multi-stage system for supplying a low temperature environment comprising a plurality of systems, each in accordance with claim 12, arranged to form a plurality of substantially parallel operating stages whereby fluid is supplied simultaneously to the input channel of each stage and further including means for thermally coupling the low temperature region of each stage, except for one stage, to a selected region of the input and output channels of at least one other stage.

25. A multi-stage system in accordance with claim 24 wherein each said thermal coupling means comprises a thermally conductive material attached from said low temperature region of a stage to said selected region of the input and output channels of said at least one other stage.

26. A multi-stage system in accordance with claim 25 wherein said thermally conductive material is a copper bar.

27. A multi-stage system in accordance with claim 25 wherein each said thermal coupling means comprises an interconnecting channel means for conveying low temperature fluid from one stage to a selected region adjacent the input and output channels of said at least one other stage before being caused to flow into the output channel of said one stage.

28. A system for providing a low temperature fluid, said system comprising a displacement volume;

input channel means not directly coupled to said displacement volume;

compressor means for providing fluid under pressure at a first temperature;

means for introducing said fluid under pressure from said compressor means into said input channel for flow therein at a substantially constant high pressure to said output channel directly coupled to said displacement volume to a region at or near said displacement volume;

means for causing said moveable means to expand said displacement volume so as to reduce the high pressure of the fluid in said output channel at said region to a substantially lower pressure and to reduce the temperature of the fluid therein to a third temperature substantially lower than said second temperature, said fluid at said lower pressure and at said third temperature flowing from said displacement volume to said output channel for flow therein;

said input and output channels being directly thermally coupled to provide a direct exchange of heat between the fluids flowing in said input channel and said output channel to precool the fluid in said input channel and to warm the fluid in said output channel; and means for supplying said warmed fluid from said output channel to said compressor means.

* * * * *